US006985085B1

(12) United States Patent
Brown

(10) Patent No.: US 6,985,085 B1
(45) Date of Patent: Jan. 10, 2006

(54) SAFETY VIEW BLIND FINDER FOR A CRANE

(76) Inventor: Eric Brown, 3006 Adayah, Arnold, MO (US) 63010

( * ) Notice: Subject to any disclaimer, the term of this patent is extended or adjusted under 35 U.S.C. 154(b) by 0 days.

(21) Appl. No.: 10/421,023

(22) Filed: Apr. 24, 2003

(51) Int. Cl.
*G08B 21/00* (2006.01)

(52) U.S. Cl. ..... 340/685; 212/276; 701/50

(58) Field of Classification Search ..... 340/685, 340/680, 686.1, 692, 668, 670; 212/276, 212/277, 279; 701/50
See application file for complete search history.

(56) References Cited

U.S. PATENT DOCUMENTS 5,027,104 A * 6/1991 Reid ..... 340/541
5,428,344 A * 6/1995 Curry et al. ..... 340/539.1
5,730,305 A * 3/1998 Ichiba et al. ..... 212/276
5,823,370 A * 10/1998 Ueda ..... 212/276
6,140,930 A * 10/2000 Shaw ..... 340/685
6,744,372 B1 * 6/2004 Shaw et al. ..... 340/685

* cited by examiner

*Primary Examiner*—Anh V. La

(57) ABSTRACT

A crane safety system providing a view of the operation of the crane to the crane operator is disclosed. The crane safety system comprises: (1) a camera sub-system having a monitor providing images to the operator, (2) a sensor sub-system for determining the presence of an object in the path of the cranes operating trajectory, and (3) a camera control device that directs and controls the camera to capture images and display the images on the monitor, the images selected by the control device based upon actions taken by the crane operator, or caused by events occurring proximal to the camera boom that are detected by the sensor sub-system. The control device further controls the sensor sub-system to select signals for processing to identify the proximity and direction of movement of the object relative to the crane. If the object is within a pre-defined distance, the control device sends an alarm signal to the monitor.

1 Claim, 5 Drawing Sheets

SAFETY VIEW BLIND FINDER FOR A CRANE

TECHNICAL FIELD

The present invention relates to crane safety methods and devices and, in particular, to improved safety devices and methods which provide a crane operator a view of the movement of portions of the crane.

BACKGROUND

Most conventional crane safety devices must be manually attached to the load each time that a new load is secured to the crane. Also, a warning beacon on the safety device can easily be obscured by the load, especially where the load is large or of an unusual shape. And, finally, the warning indicators on the device are active regardless of whether the load is actually in motion, leading to a tendency to disregard the warning indicators.

Because of these deficiencies, crane safety devices mounted proximate to moving crane parts are not widely utilized. Accordingly, there is a need for an improved crane safety device.

In addition, the devices that are most commonly used are not directed to provide information to the crane operator—the person who may have the greatest capability of influencing the safe outcome of an event leading to a potential accident. Therefore, there is an urgent need for an improved crane safety device, which directs and provides information to the crane operator.

SUMMARY

Accordingly, a crane safety system providing a view of the operation of the crane to the crane operator is disclosed. The crane safety system comprises: (1) a camera subs-system having a monitor providing images to the operator, (2) a sensor subsystem for sending signals into and receiving signals from the environment in the vicinity of the crane, and (3) a control device that directs and controls the camera to capture images and display the images on the monitor, the images selected by the control device based upon actions taken by the crane operator, or caused by events captured by the sensor sub-system occurring proximal to the crane.

The camera device is mounted on a crane boom, and captures images according to the control device. Images captured by the camera device are displayed on the monitor, which is nearby to, or in clear sight of, the crane operator.

The camera device comprises either: (a) a single camera selectable and steerable by the control device, or (b) a plurality of cameras selectable and steerable by the control device, wherein the control device selects a camera based upon an event detected by the control device, and the control steers or directs the camera to capture images related to the event. Images captured by the selected, steered camera or cameras are sent to the monitor, where they are displayed for viewing by the crane operator. Depending upon the nature of the event, the control device may send a signal that is integrated with images captured by the camera. For example the control device may send a signal that will be rendered as a warning sound to alert the operator to images that should be noticed and given attention.

The monitor comprises a video device having a display monitor with audio capability that is mounted near to the operator so that images captured by the camera are continually within the field of view of the crane operator.

The control device comprises: (a) a sensor sub-system for capturing signals from the environment in the vicinity of the crane boom; (b) a sensor processing device for processing signals, selecting, activating either a camera or a steering device; the steering device controlling the direction a camera lens points, and also controlling the focusing mechanism of a selected camera.

The sensor subsystem comprises standard transducers for generating and acquiring infrared and sonic signals, although other types of signals may be used, also. Signals, under control of the sensor-processing device, are generated by the transducers, broadcast into the vicinity, are reflected from objects in the vicinity. Transducers in the sensor sub-system capture the reflected signals, and send information related to the captured signals to the sensor-processing device.

The sensor processing device comprises stored-program logic in the form of micro-code or compiler-generated instructions for (a) controlling the sensor subsystem; (b) acquiring signals and information from the sensor subsystem; (c) signal processing algorithms to process data received from the sensor subsystem; (d) decision-control logic to select and control cameras, and; (e) communications programs to communicate with the operator, for example to send urgent signals to the monitor video and audio devices.

The crane safety system will be seen to have several benefits and advantages over prior art safety systems, for example, the safety system will transmit alerts to the crane operator only when a hazard is detected.

Another advantage is that the system is adaptable and is able to filter and select events that should be brought to the attention of the crane operator.

And another advantage is the safety system is that the operator is able to obtain information related to the environment in places outside the operator's visual field.

These advantages, benefits and others will be apparent from the descriptions and drawings that follow.

DETAILED DESCRIPTION

An Exemplary Embodiment

Figure 1:
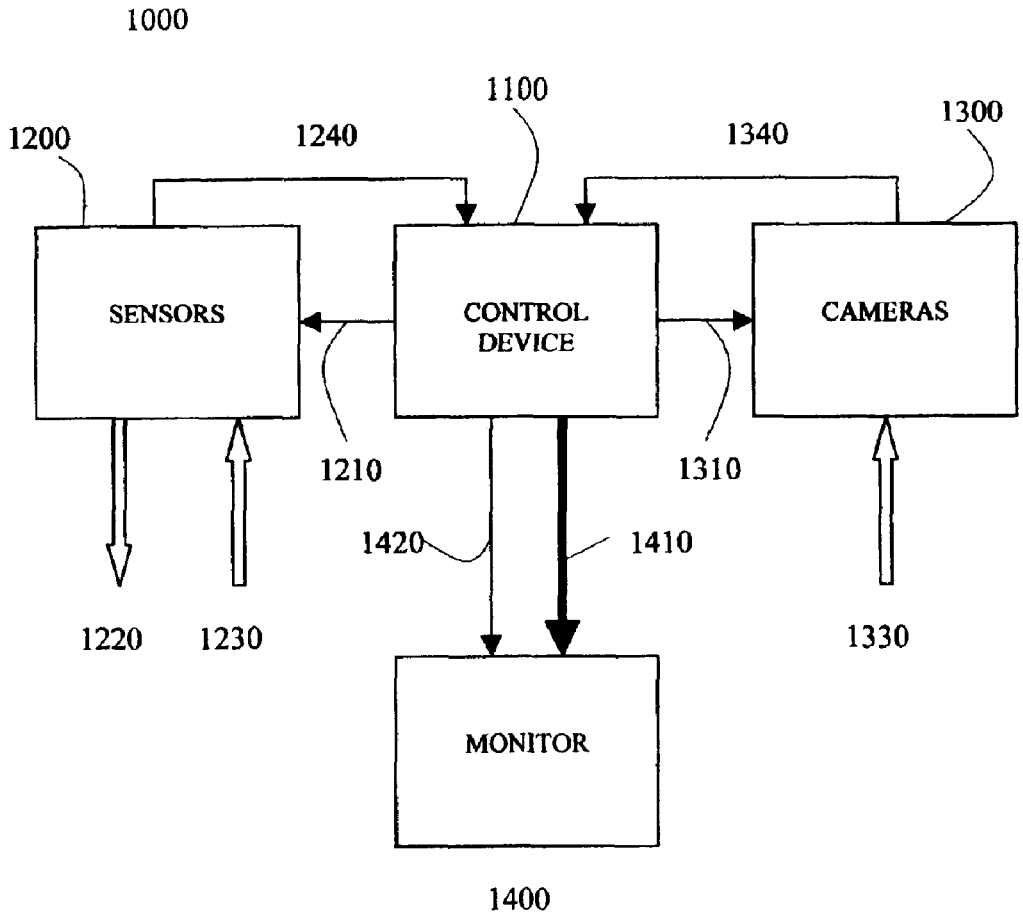
FIG. 1 is a diagram of the invention comprising a sensor subsystem having signal transducers, a camera mechanism for capturing images, a monitor for displaying images to a crane operator, and a control device for controlling the sensors, processing signals and for controlling cameras and the monitor.

With reference to FIG. 1, the invention comprises: (1) a sensor mechanism 1200 for generating and detecting signals; (2) a camera sub-system 1300 for acquiring images; (3) a monitor for displaying images captured by cameras; and (4) a control device 1100 for controlling the sensor mechanism 1200, the camera sub-system 1300, and the monitor 1400.

The control device 1100 has connections to the other devices and mechanisms of the invention; the connections may be physical-wire, optical fiber-or may be wireless, depending upon the requirements of applying the device in the operation of a crane.

The control device 1100 exchanges signals with the sensor mechanism 1200 over physical connections or communications channels or paths 1210 1240. The control device sends control signals 1210 to the sensor transducers, and receives signals 1240 from the sensor transducers. The control device activates sensors and processes signals received from the sensor transducers.

Signal processing in the control device comprises software or hardware implementation of algorithms to perform digital signal processing algorithms used to determine the distance and location of objects that have occluded signals transmitted by the sensor subsystem. The algorithms for object location and distance estimation by signal processing methods such as triangulation are well known in the art, and will not be described.

The control device 1100 communicates with the camera sub-system 1300 by means of channels or paths 1310 1340. From results computed from signals acquired by the sensors, the control device determines whether an occluding object exists in the range of the sensors. If an object is detected, the control device selects and activates a camera having the best vantage point for capturing images of the object.

The control device 1100 obtains images from the camera subsystem by the channel 1340 and routs the images to the monitor 1400, by video channel 1410. If the control device computes the object as being within a certain predetermined distance from the crane, the control device 1100 also sends a warning signal, such as a loud audio signal to the monitor over the channel 1420.

The sensor sub-system 1200 is comprised of devices capable of generating signals, for example infrared or acoustic signals. Signals transmitted by the sensor sub-system are "broadcast" into the surrounding environment of the crane, and if there is an occluding object, a certain amount of energy is reflected back to the sensor sub-system. Transducer-receivers in the sensor sub-system capture returning, reflected signals, which are sent to the control device 1100 by channel 1240. The control device 1100 may activate other sensors in order to obtain information to triangulate an occluding object, in order to compute its distance, size and rate of closure of distance to the crane.

The control device uses an internal table or some similar means to select a camera that is closest to sensors that have captured signals, or is best suited to acquire images of the occluding object.

Figure 2:
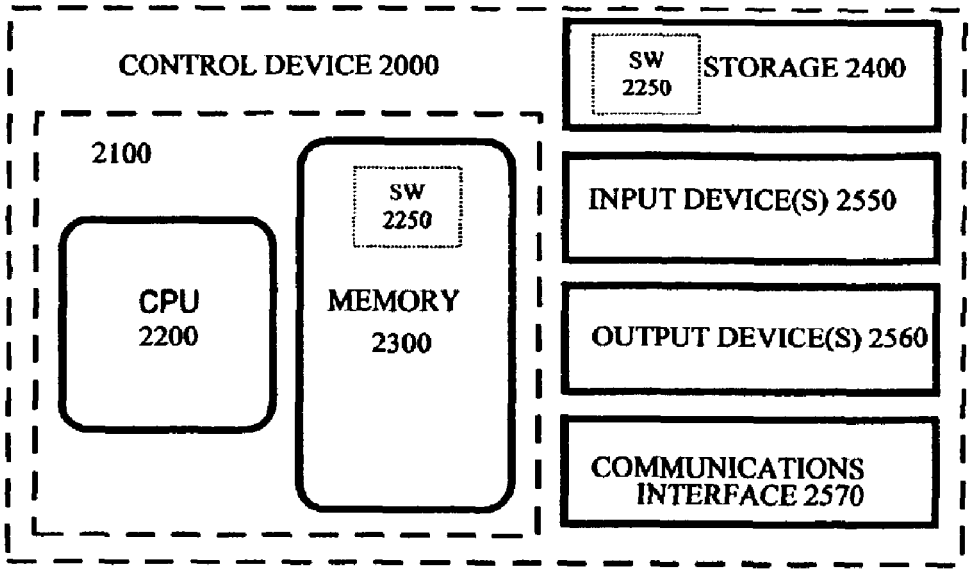
FIG. 2 shows an exemplary embodiment of the control implemented within a computing environment.

With reference to FIG. 2, the control device is implemented; for example, within a computing environment 2000, which includes at least one processing unit 1200 and memory 1300. In FIG. 2, this most basic configuration 2000 is included within 2100 a dashed line. The processing unit 2200 executes computer-executable instructions and may be a real or a virtual processor. In a multi-processing system, multiple processing units execute computer-executable instructions to increase processing power. The memory 2300 may be volatile memory (e.g., registers, cache, RAM), non-volatile memory (e.g., ROM, EEPROM, flash memory, etc.), or some combination of the two. The memory 2300 stores executable software-instructions and data 2250 -written and operative to execute and implement the software applications required to support the interactive environment of the invention.

The computing environment may have additional features. For example, the computing environment 2000 includes storage 2400, one or more input devices 2550, one or more output devices 2560, and one or more communication connections or interfaces 2570. An interconnection mechanism (not shown) such as a bus, controller, or network interconnects the components of the computing environment, for example with the servo-mechanisms and sensor device. Typically, operating system software (not shown) provides an operating environment for other software executing in the computing environment, and coordinates activities of the components of the computing environment.

The storage 2400 may be removable or non-removable, and includes magnetic disks, CD-ROMs, DVDs, or any other medium which can be used to store information and which can be accessed within the computing environment. The storage 2400 also stores instructions for the software 2250, and is configured, for example, to store signal processing algorithms, intermediate results and data generated from sensor inputs.

The input device(s) 2550 may be a touch input device such as a keyboard, mouse, pen, or trackball, a voice input device, a scanning device, or another device that provides input to the computing environment. For audio or video, the input device(s) may be a sound card, video card, TV tuner card, or similar device that accepts audio or video input in analog or digital form. The output device(s) 2560 may be a display, printer, speaker, or another device that provides output from the computing environment.

The communication interface 2570 enable the operating system and software applications to exchange messages over a communication medium 2600 with the sensor device, servo-mechanism and monitor. The communication medium conveys information such as computer-executable instructions, and data in a modulated data signal. A modulated data signal is a signal that has one or more of its characteristics set or changed in such a manner as to encode information in the signal. By way of example, and not limitation, the communication media include wired or wireless techniques implemented with an electrical, optical, RF, infrared, acoustic, or other carrier.

Figure 3:
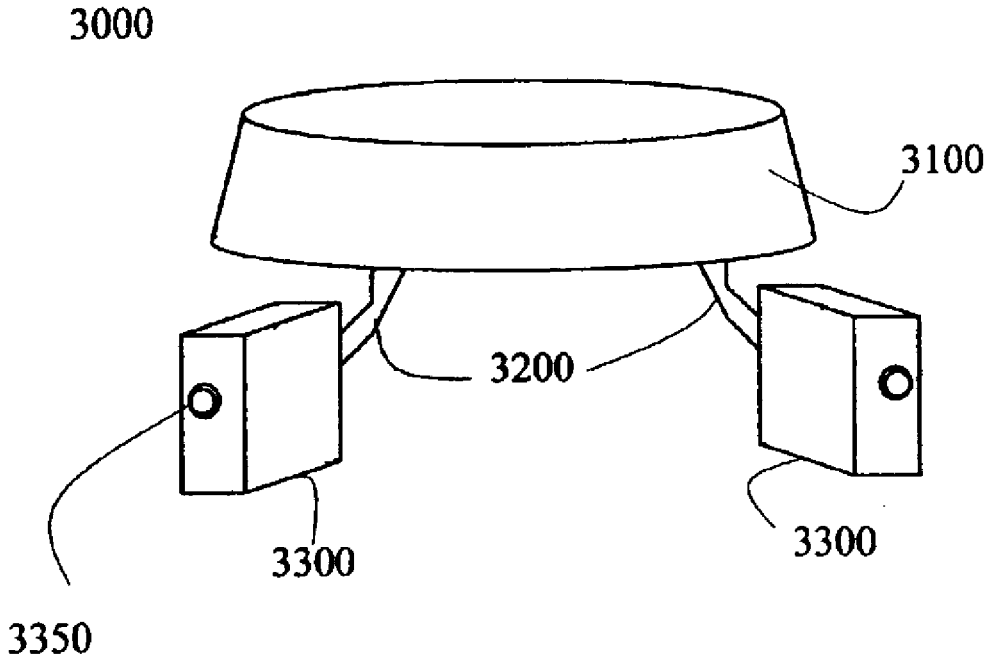
FIG. 3 shows an exemplary camera mechanism for capturing images in the vicinity of crane operations.

With reference to FIG. 3, an exemplary camera subsystem 3300 comprises a mounting-steering device 3310 for mounting cameras and for rotating or tilting cameras by direction of the control device.

The mounting steering device 3310 is mounted onto a crane at a place or location that is most appropriate to providing the view of the cranes working environment. The mounting-steering device comprises gears, motors and other components for rotating, and tilting the cameras 3330, which are attached thereto. Sensors 3320 may also be attached either to the mounting-steering device directly or may be installed or mounted directly on the cameras.

The cameras 3330 are "hardened" or made to withstand the rigors of an industrial environment, and have lenses 3340 that are selected and controlled by the control device.

Figure 4:
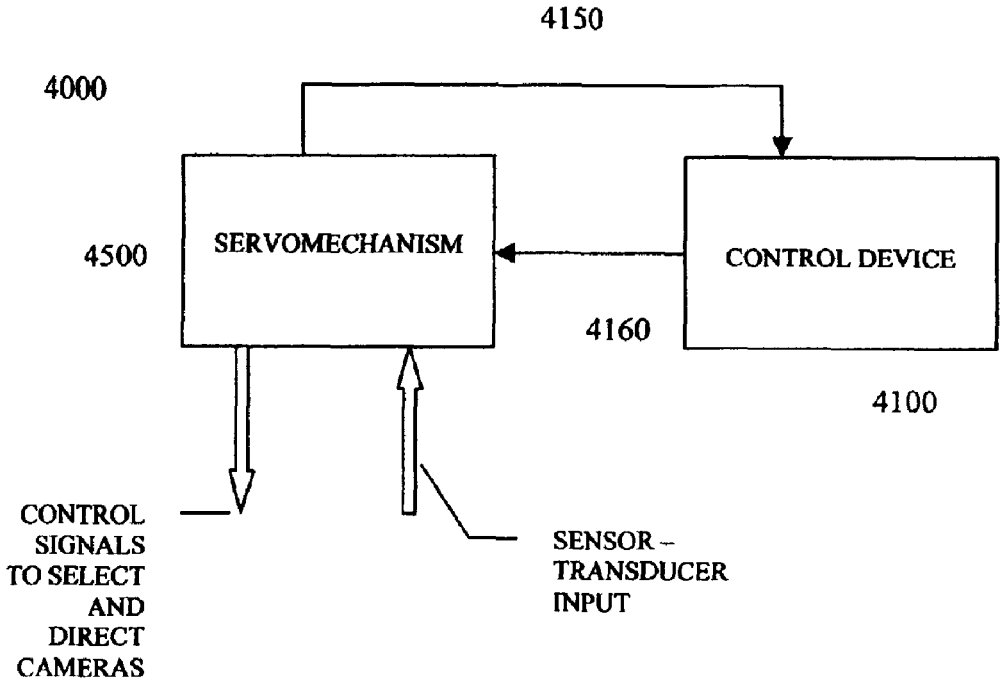
FIG. 4 is a logic diagram of the operation of the control device, and servomechanisms for controlling the camera mechanism and the sensor devices.

In an exemplary operation, and with reference to FIG. 4, the combined devices 4000 operate as a closed-loop feedback control system in that the control device 4100 controls servo-mechanisms 4500 of the camera, sensor sub-systems in order to position and select cameras and sensors. From signals obtained through input channels 4150, the control device 4100 selects sensors and cameras, and receives sensor-transducer input signals, which are processed. Based upon processing the control device 4100 sends further signals to the servo-mechanism 4500 thorough control channel 4160 to select and sensors and cameras.

Figure 5:
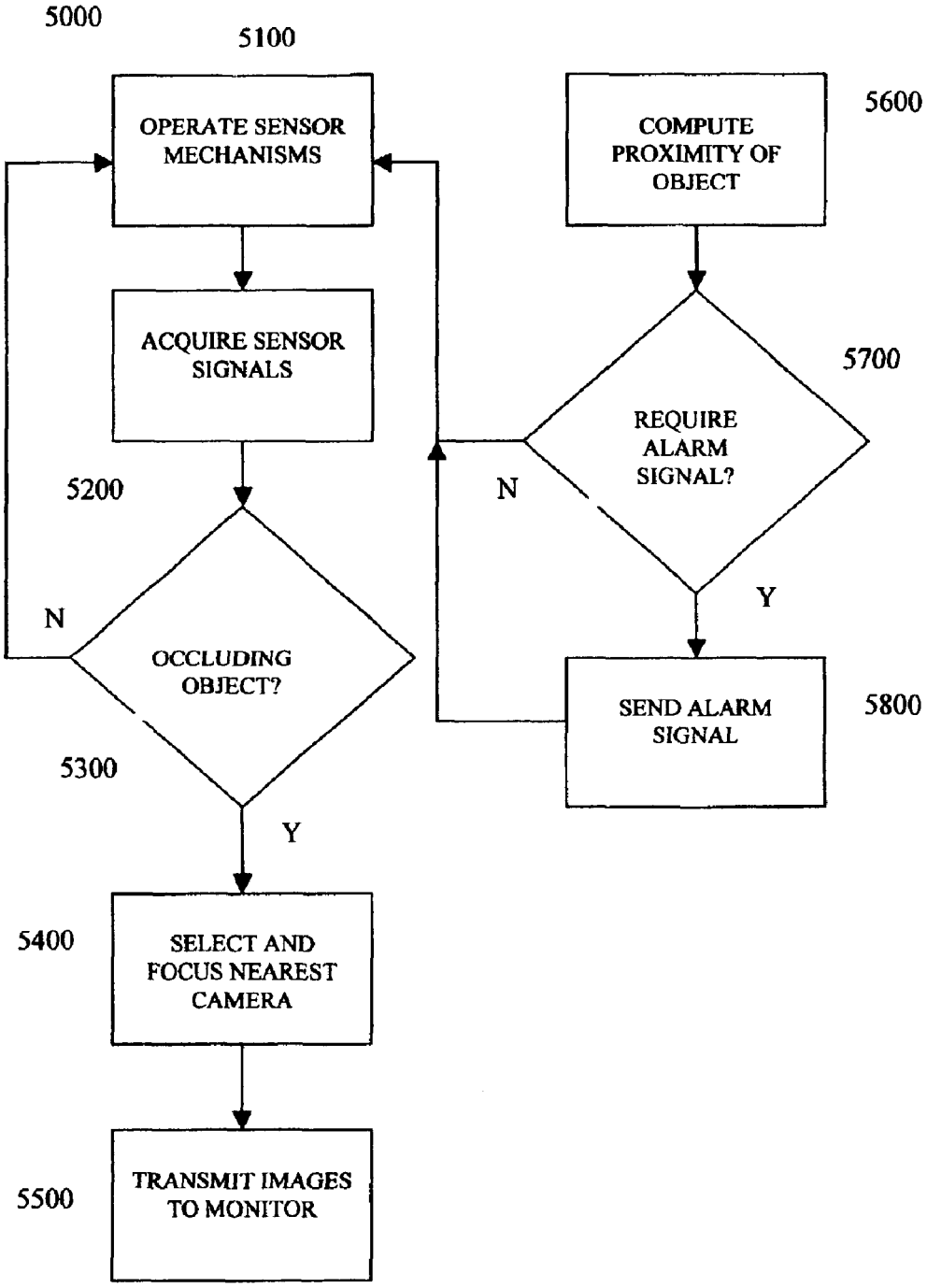
FIG. 5 is a logic flow diagram of the operation of the control device.

With reference to FIG. 5., the control device executes the steps of the process 5000, comprising: (1) in step 5100, the control devices activates and operates the sensors; (2) in step 5200, the control device acquires signals from the sensor transducers; (3) in step 5300, the control device processes signals acquired and determines whether an occluding object has been detected; (4) if an occluding object has been detected, in step 5400, the control device selects and focuses a nearest camera or cameras to capture images of the occluding object; (5) in step 5500, images are transmitted to the monitor, which is located in the vicinity of the crane operator; (6) the control device in step 5600 computes the proximity of the object, and (7) in step 5700, if the proximity is within a predetermined distance, the control device (8) in step 5800, the control device sends an alarm signal to the monitor, preferably a loud audio alarm signal.

The invention has been disclosed in an exemplary embodiment. In view of this disclosure, it will be appreciated that variations in the location, arrangement and components are possible, therefore the scope of the invention is most properly described by the claims that follow.

I claim:

1. A device for warning a crane operator, the warning related to an object undetected by the crane operator, the object in the path of the motion of the crane boom, the device comprising:

a sensor mechanism, the sensor mechanism sending a signal to an area near to the crane boom, the sensor mechanism detecting the signal interacting with an object near to the crane boom, the signal identifying the proximity and direction of movement of the object relative to the crane boom;

a steerable camera for acquiring images in an area near to the crane boom;

a monitor for displaying images sent by the camera;

a control mechanism for controlling the sensor mechanism, said sensor control mechanism comprising causing the sensor mechanism to send signals, the control mechanisms for processing a detected signal interacting with the object and the control mechanism further controlling the sensor mechanism and the camera according to processing of the detected signal;

whereby the control mechanism detects objects in an area near the crane boom steers and causes the camera to send images of said object to the monitor, and the operator observes the object in said monitor.

* * * * *